US011535429B2

(12) United States Patent
Clavel et al.

(10) Patent No.: US 11,535,429 B2
(45) **Date of Patent: *Dec. 27, 2022**

(54) BREAKABLE LOCKING CAP FOR A CONTAINER COMPRISING A NECK

(71) Applicant: A. RAYMOND ET CIE, Grenoble (FR)

(72) Inventors: Maxime Clavel, Vif (FR); Gaëtan Rey, Voiron (FR)

(73) Assignee: A. RAYMOND ET CIE, Grenoble (FR)

( * ) Notice: Subject to any disclaimer, the term of this patent is extended or adjusted under 35 U.S.C. 154(b) by 82 days.

This patent is subject to a terminal disclaimer.

(21) Appl. No.: 16/911,060

(22) Filed: Jun. 24, 2020

(65) Prior Publication Data

US 2021/0009319 A1 Jan. 14, 2021

(30) Foreign Application Priority Data

Jul. 9, 2019 (FR) ..... 1907696

(51) Int. Cl.

| | |
|---|---|
| ***B65D 45/30*** | (2006.01) |
| ***A61J 1/14*** | (2006.01) |
| ***B65D 1/02*** | (2006.01) |
| ***B65D 39/00*** | (2006.01) |
| ***B65D 85/00*** | (2006.01) |

(52) U.S. Cl.

CPC ..... *B65D 45/30* (2013.01); *A61J 1/1412* (2013.01); *B65D 1/023* (2013.01); *B65D 39/0076* (2013.01); *B65D 85/70* (2013.01)

(58) Field of Classification Search

CPC ..... B65D 41/62; B65D 55/06; B65D 2251/0015; B65D 45/30; B65D 1/023; B65D 39/0076; B65D 85/70; A61J 1/1412

See application file for complete search history.

(56) References Cited

U.S. PATENT DOCUMENTS 2,950,834 A * 8/1960 Ralph ..... B65D 55/063 215/254
4,506,797 A * 3/1985 Bullock, III ..... B65D 41/62 215/256

(Continued)

FOREIGN PATENT DOCUMENTS

EP 2464577 B1 6/2012
EP 2464580 B1 6/2012

(Continued)

*Primary Examiner* — Shawn M Braden

(74) *Attorney, Agent, or Firm* — TraskBritt

(57) ABSTRACT

The invention relates to a locking cap for a container comprising a neck, intended to block a stopper in the neck of the container and comprising: an external body having a breakable part, a cage that is configured to fit into and lock axially in the external body, and having a breakable zone, the cage further comprising: an upper ring, a plurality n of branches that are connected to the upper ring and define therewith a generally cylindrical shape, n/2 first bridges and n/2 second bridges, each interconnecting two adjacent branches, at least one opening tab, which is supported by a second bridge, which is inclined toward the outside of the cage and is oriented toward the upper ring, the opening tab being adjacent to the breakable zone, which is located on the second bridge.

10 Claims, 5 Drawing Sheets

(56) References Cited

U.S. PATENT DOCUMENTS

| | | | | |
|---|---|---|---|---|
| 5,269,429 | A | 12/1993 | Schumacher | |
| 7,210,592 | B1 * | 5/2007 | Dautreppe | B65D 41/62 206/497 |
| 2009/0020535 | A1 * | 1/2009 | Joubert | B65D 51/18 220/521 |
| 2009/0152269 | A1 * | 6/2009 | Pucci | B65D 47/0823 220/254.3 |
| 2010/0012615 | A1 * | 1/2010 | Brooks | B65D 45/322 215/256 |

FOREIGN PATENT DOCUMENTS

| | | | |
|---|---|---|---|
| EP | 2814752 | B1 | 12/2014 |
| WO | 2012/069538 | A1 | 5/2012 |

* cited by examiner

BREAKABLE LOCKING CAP FOR A CONTAINER COMPRISING A NECK

PRIORITY CLAIM

This application claims the benefit of the filing date of French Patent Application Serial No. FR1907696, filed Jul. 9, 2019, for "Breakable Locking Cap for a Container Comprising a Neck," the disclosure of which is hereby incorporated herein in its entirety by this reference.

TECHNICAL FIELD

The present disclosure relates to a cap for a container comprising a neck, intended to block a stopper in the neck of the container. The present disclosure relates in particular to a locking cap suitable for bottles, for example for pharmaceutical products, requiring the stopper and the cap to be completely removed in order to extract or reconstitute the product.

BACKGROUND

EP2814752 is known, which proposes a completely removable device for locking a stopper to a container comprising a neck. This device comprises an outer ring shaped to cover the stopper and surround the upper collar of the neck of the container. It also comprises an annular inner ring that is capable of being housed in the outer ring and is provided with lower internal notches that are intended to bear under the collar in order to be fixed to the container. The inner ring also comprises external notches that allow it to be secured in the outer ring. Such a cap makes it possible to block a stopper in the neck of the container, the stopper being held in the inner ring.

These locking devices are usually used to store pharmaceutical products in bottles. Some products are withdrawn using a syringe, which is inserted through the elastomer stopper, after removal of a protective capsule in the upper part of the locking device. Other products require the bottle to be completely opened in order to be extracted therefrom or reconstituted.

The above-mentioned document provides a frangible zone, in the region of the outer ring of the locking device, which is capable of being broken to allow the ring to be opened and withdrawn relative to the collar of the container. The inner ring is in turn provided with a deformable and breakable bridge, which is capable of being broken to allow the ring to be withdrawn relative to the collar, which allows access to the stopper and allows it to be withdrawn from the neck of the container.

A drawback of this solution comes from the lack of repeatability of the opening between two devices, in particular from breaking the breakable deformable bridge, since it is difficult to pull on the inner ring in a repeatable manner until the bridge breaks. Another drawback of this solution comes from the lack of repeatability of the assembly between the inner and outer rings, which assembly must seal the closure.

EP2464577 sets out a device for locking a stopper in the neck of a reliable and repeatable container in terms of sealing the closure, but does not allow the device to be completely removed in order to extract the stopper.

U.S. Pat. No. 5,269,429 proposes a closure lid that comprises a breakage point, so as to allow the lid to be removed.

BRIEF SUMMARY

The present disclosure proposes an alternative to the known solutions and aims to remedy all or some of the drawbacks of the prior art. The present disclosure relates to a locking cap that reliably ensures the sealing of the closure and allows removal of the cap that is both ergonomic and secure and is repeatable on a plurality of caps, in order to extract the elastomer stopper and access the contents of the container.

The present disclosure relates to a locking cap for a container comprising a neck, intended to block a stopper in the neck of the container and comprising:

- an external body having a breakable part,
- a cage that is configured to fit into and lock axially in the external body and is intended to surround a collar of the neck of the container in a locked position of the cap, the cage having a breakable zone.

The breakable part of the external body and the breakable zone of the cage are designed such that, when the cap is in the locked position on the container, the breakage of the breakable part and the breakable zone enables the cap to be removed from the container.

The locking cap is remarkable in that the cage comprises:

- an upper ring, against which the stopper is intended to bear when it is arranged in the cage,
- a plurality n of branches, which are connected to the upper ring and define therewith a generally cylindrical shape of the cage,
- n/2 first bridges and n/2 second bridges, each interconnecting two adjacent branches, the first bridges and the second bridges being arranged alternately over the periphery of the cage,
- at least one opening tab, which is supported by a second bridge that is inclined towards the outside of the cage and is oriented towards the upper ring, the opening tab being adjacent to the breakable zone, which is located on the second bridge, the application of a tensile force to the opening tab being capable of causing breakage in the breakable zone.

According to other advantageous and non-limiting features of the present disclosure, taken in isolation or in any technically feasible combination:

- the cage comprises a plurality of first flexible tabs that are intended to block the stopper inside the cage, against the upper ring, when the cap is in an intermediate holding position, each first tab being supported by a first bridge;
- the cage comprises a plurality of second flexible tabs that are intended to bear under a collar of the neck of the container when the cap is in the locked position, each second tab being supported by a second bridge;
- the first bridges occupy between 20% and 40% of the periphery of the cage and the second bridges occupy between 40% and 70% of the periphery;
- the first bridges are located, in an axial direction, between the upper ring and the second bridges, each first bridge being designed to provide an open space between itself and the collar when the cap is in the intermediate holding position;
- each open space has a height, in the axial direction, of between 0.2 mm and 2 mm, and a width, along the periphery of the cage, which is substantially equal to the width of a first bridge.

The present disclosure further relates to a container comprising a neck having a circular opening that ends in a flared collar, and comprising a stopper that is arranged in the neck and is connected to the locking cap as described herein.

Advantageously, each second tab is inclined toward the inside of the cage, in the direction of the upper ring, and the n/2 second tabs of the cage are configured to allow the cap to pass from the intermediate holding position into the locked position of the cap on the container when a force of between 30 N and 70 N, preferably of between 30 N and 50 N, is applied to the cap.

BRIEF DESCRIPTION OF THE DRAWINGS

Other features and advantages of embodiments of the present disclosure will become clear from the following detailed description of example embodiments with reference to the accompanying drawings, in which.

DETAILED DESCRIPTION

Figure 1A:
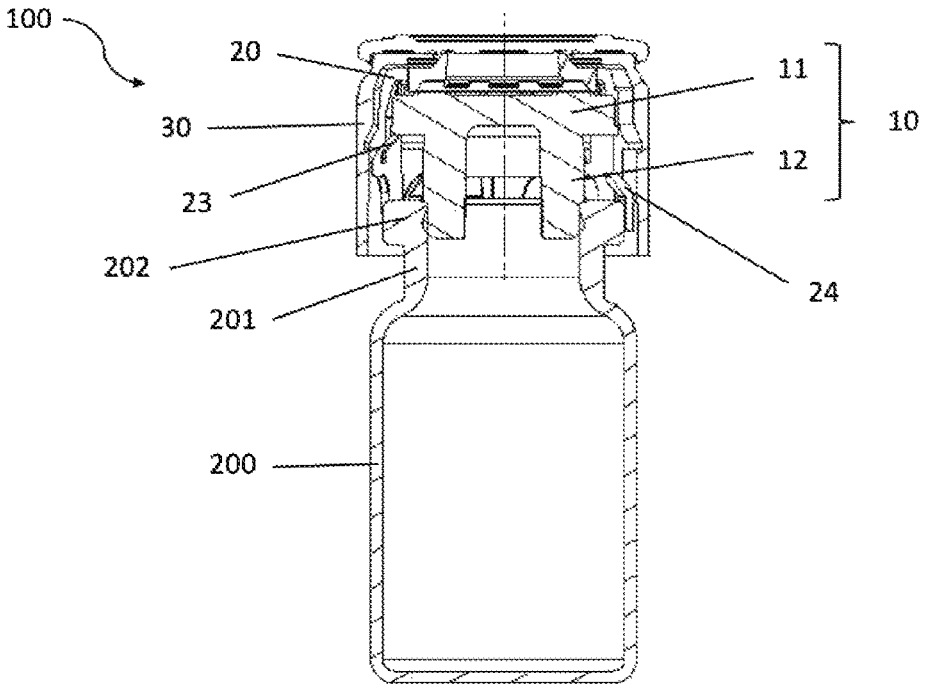
FIGS. 1A and 1B are cross-sectional views, along two orthogonal sections, of a container comprising a neck with a stopper partially pressed into the neck and a locking cap according to the present disclosure, in an intermediate holding position.

In the descriptive part, the same reference signs in the drawings can be used for elements of the same type. The drawings are schematic representations that, for the sake of readability, are not necessarily to scale.

The present disclosure relates to a locking cap 100 for a container 200 comprising a neck, intended to block a stopper 10 in the neck 201 of the container 200. The container 200 may, in particular, take the form of a bottle, comprising a neck 201 having a circular opening, which ends in a collar 202 that is flared relative to the external periphery of the neck 201. In other words, the external diameter of the collar 202 is greater than the external diameter of the neck 201, as shown in FIGS. 1A and 1B.

In the field of pharmaceutical applications, there are standards in terms of the internal diameter of the neck 201 of the container 200: 13 mm and 20 mm are examples thereof.

The stopper 10 has a circular section and a T-shape having a head 11 and a foot 12, the head 11 having a diameter that is greater than the foot 12. Therefore, when the foot 12 of the stopper 10 is fully pressed into the neck 201, the head 11 is blocked against the collar 202.

Figure 1B:
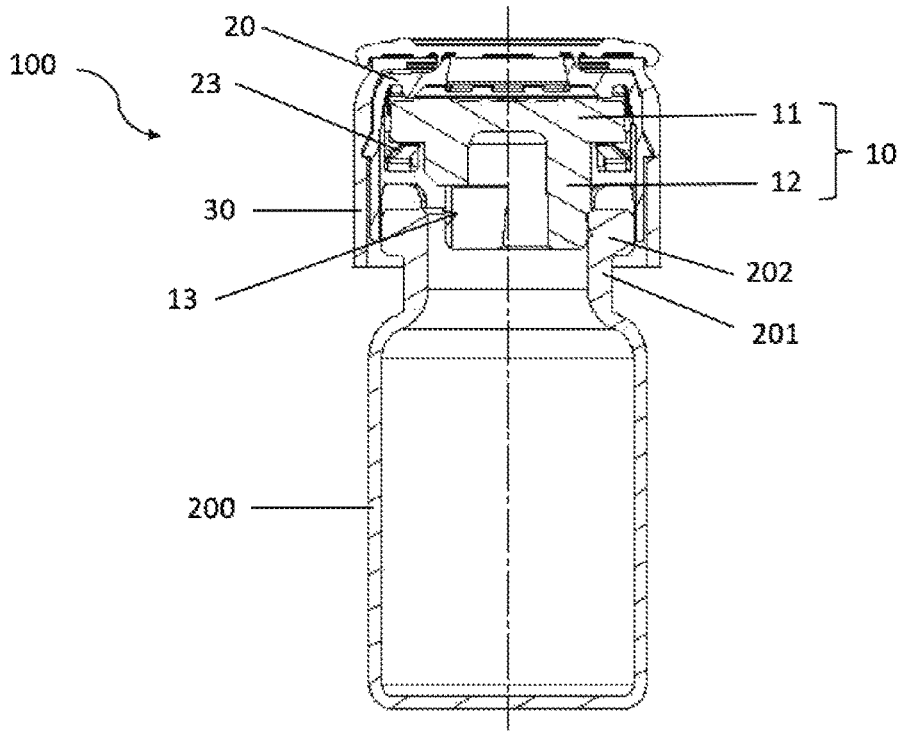
Figure 1C:
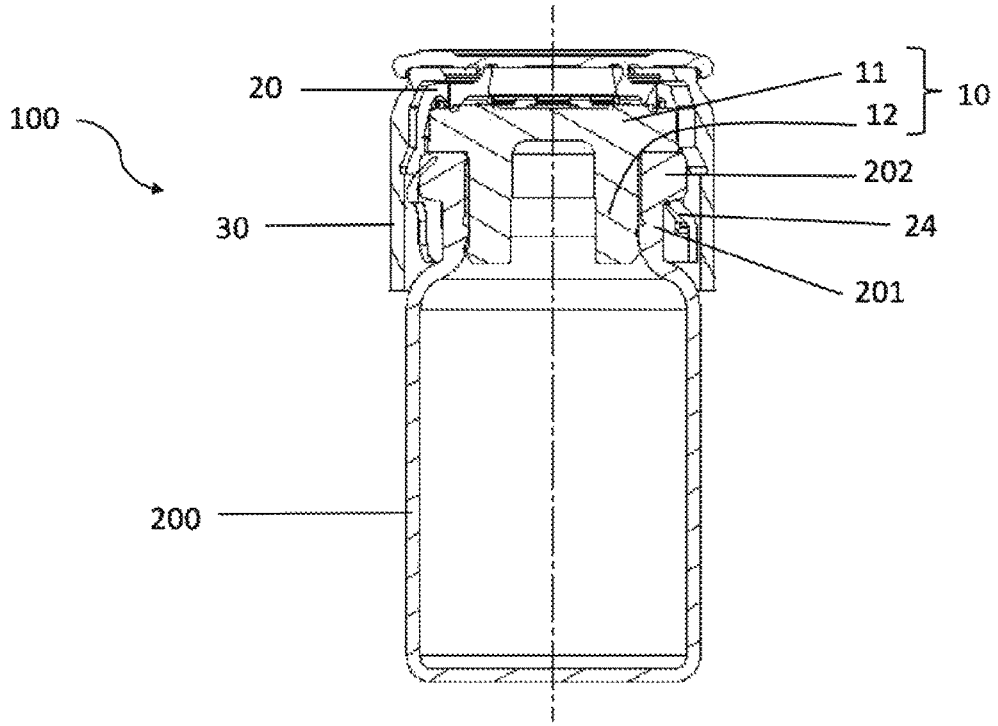
FIGS. 1C and 1D are cross-sectional views, along two orthogonal sections, of a container comprising a neck with a stopper pressed into the neck and a locking cap according to the present disclosure, in a locked position.
Figure 1D:
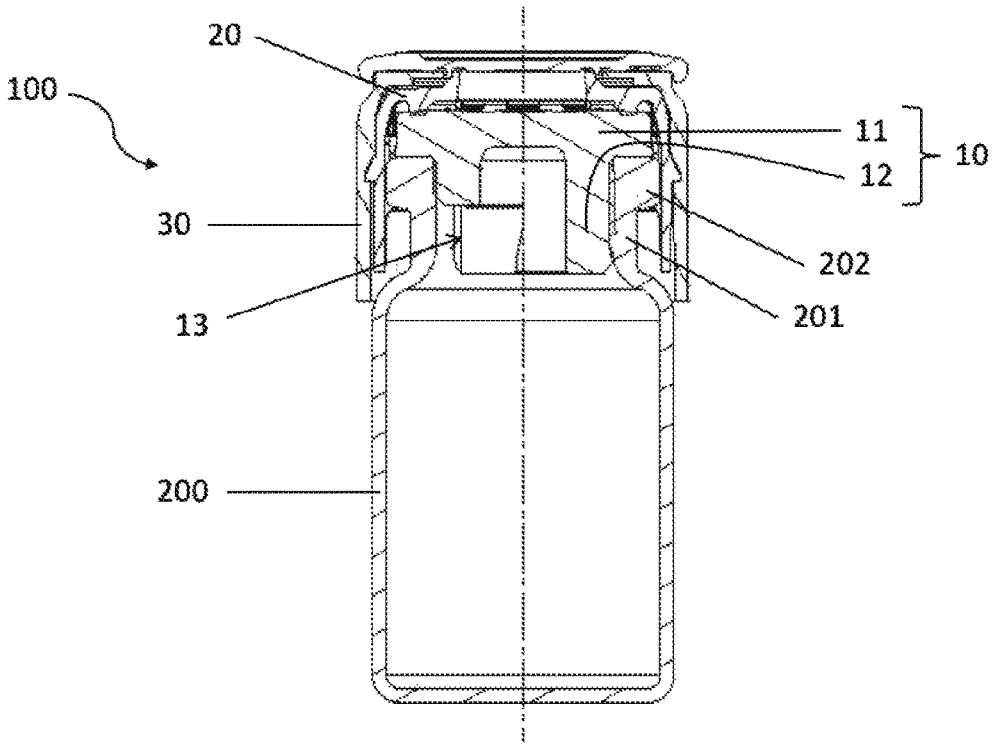

It should be noted that, when the contents of the bottle are intended to be lyophilized, the stopper 10 has an opening 13 in its foot 12 to allow the passage of evaporative flows as long as the stopper 10 is not completely pressed into the neck 201 (FIGS. 1B and 1D).

The locking cap 100, when connected to the stopper 10, is capable of adopting two positions on the container 200: a first position, referred to as an intermediate holding position, in which the stopper 10 is partially pressed into the neck 201 (FIGS. 1A and 1B). The container 200 can be subjected to a lyophilization step while the locking cap 100 is in the intermediate holding position, because the stopper being only partially pressed in allows the evaporative flows to pass through the opening 13 formed in the foot 12 of the stopper 10. The advantageous features of the locking cap 100 that allow these evaporative flows to circulate effectively will be described below.

The locking cap 100 associated with the stopper 10 can also adopt a second position, referred to as the locked position, in which the stopper 10 is fully pressed in and locked in the neck 201 by the locking cap 100 (FIGS. 1C and 1D). In this position, the stopper 10 hermetically closes the container 200, the foot 12 (and therefore the opening 13 when it is present) being completely surrounded by the neck 201 of the container 200.

The locking cap 100 comprises an external body 30 and a cage 20 configured to fit into and lock axially in the external body 30.

Figure 2A:
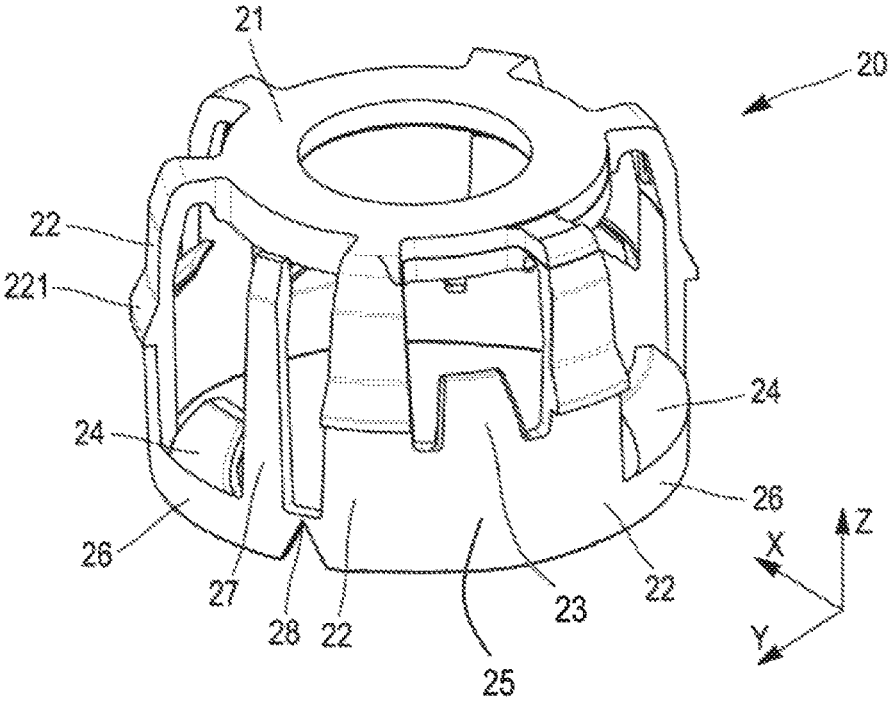
FIGS. 2A and 2B are top perspective views of cages of a cap for locking a container comprising a neck, according to the present disclosure.
Figure 2B:
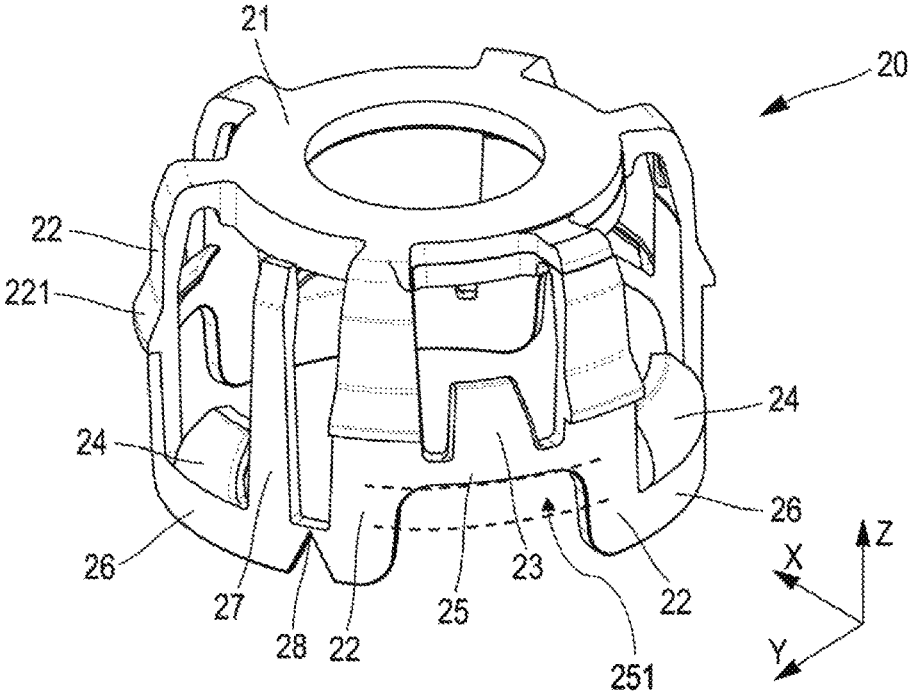

The cage 20 comprises an upper ring 21, a plurality n of branches 22, which are connected to the upper ring 21 and define therewith a generally cylindrical shape of the cage 20, with a central axis z (FIGS. 2A and 2B).

The cage 20 also comprises n/2 first bridges 25 and n/2 second bridges 26, each interconnecting two adjacent branches 22. The first bridges 25 and the second bridges 26 are arranged alternately over the periphery of the cage 20. In the examples shown in FIGS. 2A and 2B, the cage has six branches 22, three first bridges 25 and three second bridges 26.

Advantageously, the first bridges 25 occupy between 20% and 40% of the periphery of the cage 20, for example 30%; the second bridges 26 occupy between 40% and 70% of the periphery, for example 60%. The remaining periphery to reach 100% is occupied by the branches 22.

Preferably, the cage 20 comprises a plurality of first tabs 23, each being supported by a first bridge 25. Each first tab 23 is flexible and is inclined relative to the branches 22 towards the inside of the cage 20, at an angle of between 20° and 60°, advantageously around 45°, in the direction of the upper ring 21.

These first tabs 23 are intended to block the stopper 10 inside the cage 20, against the upper ring 21, when the stopper 10 is connected to the locking cap 100. The first tabs 23 flex to allow the head 11 of the stopper 10 to pass when the stopper is introduced into the cage 20, and become blocked under the head 11 in order to prevent the stopper 10 from being pulled out of the cage 20.

Owing to these first tabs 23, the stopper 10 remains secured to the locking cap 100 and the stopper 10 and locking cap 100 cannot become accidentally separated, in particular when the locking cap 100 is in its intermediate holding position on the container 200.

The cage 20 advantageously comprises a plurality of second tabs 24, each being supported by a second bridge 26. Each second tab 24 is flexible and is inclined relative to the branches 22 towards the inside of the cage 20, at an angle of between 20° and 60°, advantageously around 30°, in the direction of the upper ring 21.

These second tabs 24 are intended to remain above the collar 202, to be slightly raised or to be in contact therewith, when the locking cap 100 is in the intermediate holding position (FIG. 1A). In this intermediate holding position, the second bridges 26 and the branches 22 are intended to surround the collar 202 at least in part. This configuration allows the stopper 10/locking cap 100 assembly to be more stably and securely mechanically held during potential lyophilization steps.

Furthermore, the second tabs 24 are intended to bear under the collar 202 of the neck 201 of the container 200 when the locking cap 100 is in the locked position (FIG. 1C). In fact, when passing into the locked position, the stopper 10/locking cap 100 assembly will descend into and around the neck 201 of the container 200 so as to completely press the foot 12 of the stopper 10 into the neck 201 until the head 11 thereof is resting on the collar 202. While being pressed in, the second tabs 24 flex and move aside to allow the collar 202 to pass, and become blocked under the collar 202, thus locking the stopper 10 on the container 200.

It should be noted that, in the locked position, the first tabs 23 move aside because they are bearing against the peripheral edge of the collar 202. They therefore do not remain under the head 11 of the stopper 10 and let the head bear against the collar 202. The first bridges 25 then surround the peripheral edge of the collar 202.

Advantageously, the second tabs 24 are configured to allow the cap to pass from the intermediate holding position into the locked position of the locking cap 100 connected to the stopper 10 when a low force of between 30 N and 70 N, preferably of between 30 N and 50 N, is applied to the locking cap 100. For this purpose, the second tabs 24 have an inclination relative to the branches 22 of 20° to 60°, a thickness of between 0.6 and 1.3 mm and a flexibility conferred by the selection of the material forming the cage 20.

This advantageous configuration, by means of which the passage into the locked position is made possible by the application of a low-amplitude force, makes it possible to collectively lock a plurality of locking caps 100 on their respective containers 200 by means of a plate exerting a force in the upper part of the plurality of locking caps 100. This low closing force also makes it possible to compensate for the significant variations in height of the containers 200 and thus to achieve closure of all of the containers present under the closing plate without causing any breakage.

The locking cap 100 according to the present disclosure is completely removable and allows the stopper 10 to be withdrawn to completely open the container.

The cage 20 comprises at least one second bridge 26 supporting an opening tab 27 inclined towards the outside of the cage 20, in the direction of the upper ring 21. The (at least one) second bridge 26 also has a breakable zone 28 adjacent to the opening tab 27 (FIGS. 2A and 2B).

Figure 3A:
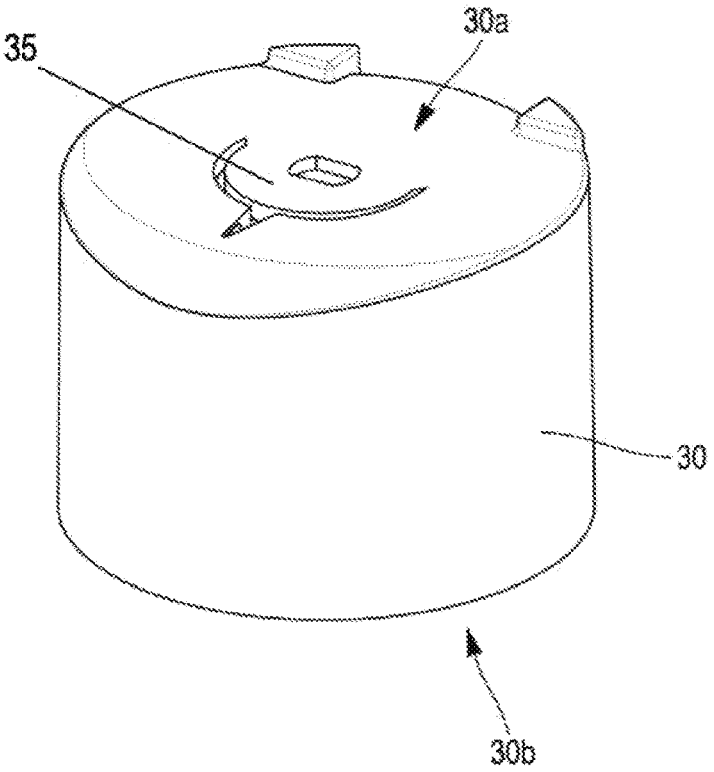
FIG. 3A is a top perspective view of an external body of a locking cap according to the present disclosure.
Figure 3B:
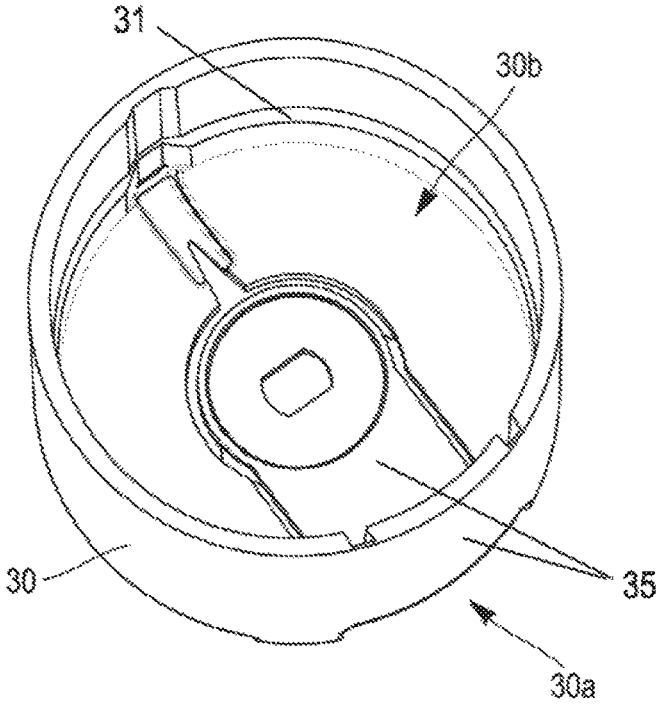
FIG. 3B is a bottom perspective view of the external body of FIG. 3A.

The external body 30 also has a breakable part 35 (FIGS. 3A and 3B). The external body 30 has a generally cylindrical shape having a central axis z. One end 30*a* of the external body 30 is closed and the other end 30*b* is open. The open end 30*b* is designed to accommodate the cage 20, which will fit with the external body 30, arranging the upper ring 21 against the interior surface of the closed end 30*a*. The breakable part 35 could for example consist of a portion of the closed end 30*a* and of the cylindrical wall, the portion being delimited by a double groove, in the region of which the thickness of the external body 30 is reduced (FIG. 3B).

The external body 30 is configured to completely surround the cage 20 when the cage is fitted, so as to prevent any access to the cage 20 from the outside when the locking cap 100 locks the stopper 10 to the container 200. In the locked position of the locking cap 100, the external body 30 therefore in particular prevents access to the opening tab 27.

Figure 3C:
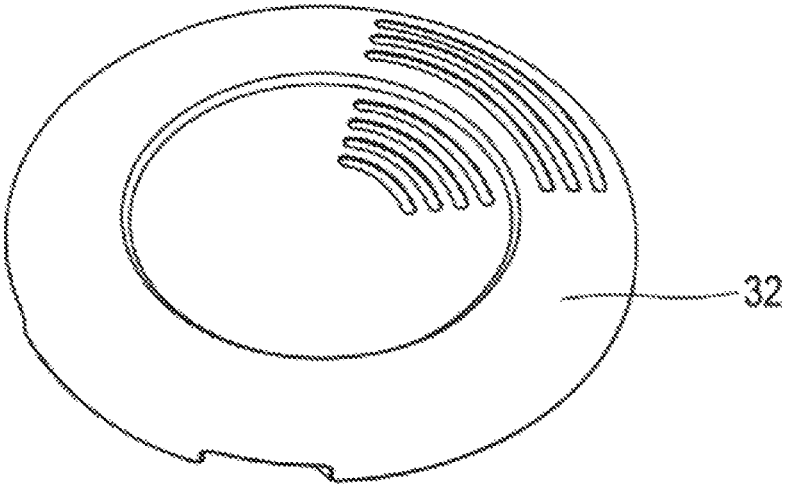
FIG. 3C is a top perspective view of a cap of an external body of a locking cap according to the present disclosure.
Figure 3D:
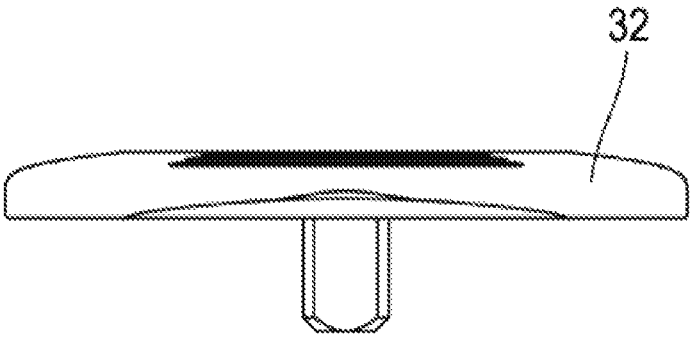
FIG. 3D is a side view of the cap of FIG. 3C.

A top cap 32, shown in FIGS. 3C and 3D, is fixed to the external surface of the closed end 30*a* of the external body 30. For this purpose, the top cap 32 may comprise a lug intended to pass through an orifice (visible in FIG. 3A) that is present, for example, in the center of the closed end 30*a* of the external body 30, and in particular in the portion of the end belonging to the breakable part 35. The top cap 32 and the external body 30 can be attached to one another by heat stacking.

In practice, when someone wants to access the contents of the container 200, an edge of the top cap 32 is raised in order to grasp it and exert a tearing force. This force is transmitted from the top cap 32 to the breakable part 35 by means of the lug, which is heat-stacked into the orifice of the closed end 30*a* of the external body 30. If sufficient, this force will cause a break in region of the double groove due to its reduced thickness. Since a portion of the closed end 30*a* and of the cylindrical wall of the external body 30 is omitted, the external body 30 can be easily removed.

This gives access to the cage 20, which locks the stopper 10 in the neck 201 of the container 200. It should be noted that the opening tab 27 is initially designed such that it is inclined towards the outside of the cage 20, in the direction of the upper ring 21; because of its resilient properties, it is able to fold down in parallel with the internal walls of the external body 30 when the cage 20 is locked axially in the external body 30. When the external body 30 is removed, the opening tab 27 advantageously returns to its initial inclination towards the outside of the cage 20, which makes it easier for the user to grasp it. The opening tab 27 advantageously has an elongate shape, which further facilitates gripping.

The gripping and the application of a tensile force to the opening tab 27 causes breakage at the breakable zone 28 of the second bridge 26, and the cage 20 can then be easily detached from the neck 201 of the container 200, leaving it freely accessible for removing the stopper 10.

By means of its shape, inclination and location relative to the breakable zone 28 formed on a second bridge 26, the opening tab 27 promotes reliable and repeatable breakage on a plurality of cages 20.

Returning to the description of other elements of the locking cap 100 according to the present disclosure, the external body 30 comprises a circular groove 31, which is made in its cylindrical internal walls and is able to cooperate with complementary means of the cage 20, in order to axially lock the cage 20 in the external body 30 (FIG. 3B). These means are, for example, notches 221 that are made on the branches 22 of the cage 20 (visible in FIGS. 2A and 2B) and are designed to become blocked in the groove 31 when the cage 20 is completely inserted into the external body 30. The external body 30 can thus rotate freely about the central axis z when the locking cap 100 is in the locked position on the container 200 without damaging the cage 20 and risking affecting the reliability and the closure sealing of the container 200.

According to an embodiment that is particularly suitable for implementing lyophilization steps, each first bridge 25 is designed to provide an open space 251 between itself and the collar 202 when the locking cap 100 is in its intermediate holding position (FIG. 2B). The cage 20 thus has n/2 open spaces 251, which are distributed over the periphery of the cage 20, allowing the evaporative flows to be efficiently evacuated during lyophilization steps.

Advantageously, each open space 251 has a height, in the axial direction z, of between 0.2 mm and 2 mm, and a width, along the periphery of the cage 20, which is substantially equal to the width of a first bridge 25. The height of the open space 251 can be defined as the distance, in the axial direction z, between the first bridge 25 and a line marking the start of the inclination of the second tabs 24 towards the inside of the cage 20. Indeed, it is at this line marking the start of the inclination that the contact between the collar 202 and the second tabs 24 is capable of being established, thus defining the intermediate holding position.

The various elements forming the locking cap 100 according to the present disclosure (cage 20, external body 30, top cap 32) are preferably produced by plastics molding, which is compatible with the lyophilization methods (when required), with the gamma sterilization methods, autoclave sterilization methods, and ethylene oxide (ETO) sterilization methods, and with the intended fields of application. For example, the cage 20, the external body 30 and the top cap 32 may be made of materials such as polycarbonate (PC), polypropylene (PP) or polybutylene terephthalate (PBT). It should be noted that the top cap 32 may be formed from flexible plastics materials, such as polypropylene (PP), in order to make it easier to grasp.

It should also be noted that, since the stopper 10 can be introduced into the locking cap 100 after assembly of the cage 20, the external body 30 and the top cap 32 forming the locking cap 100, it is advantageously possible to store the locking cap 100 and the stopper separately before use.

Of course, the invention is not limited to the embodiments and examples described, and it is possible to provide variant embodiments without departing from the scope of the invention as defined by the claims.

What is claimed is:

1. A locking cap for blocking a stopper in a neck of a container for pharmaceutical products, comprising:

an external body having a breakable part;

a cage configured to fit into and lock axially in the external body and to surround a collar of a neck of a container in a locked position of the locking cap, the cage having a breakable zone, the cage including:

an upper ring, against which the stopper bears when the stopper is disposed in the cage;

a plurality n of branches, which are connected to the upper ring and define therewith a generally cylindrical shape of the cage;

n/2 first bridges and n/2 second bridges, each interconnecting two adjacent branches, the first bridges and the second bridges being arranged alternately over the periphery of the cage; and at least one opening tab supported by a second bridge of the n/2 second bridges, the at least one opening tab being inclined toward the outside of the cage and oriented toward the upper ring, the at least one opening tab being adjacent to the breakable zone, the breakable zone located on the second bridge, the breakable zone configured to break in response to application of a tensile force to the at least one opening tab; and wherein the breakable part of the external body and the breakable zone of the cage are configured such that, when the cap is in the locked position on the container, the breakage thereof enables the cap to be removed from the container.

2. The locking cap of claim 1, wherein the cage further comprises:

a plurality of first flexible tabs configured to block the stopper inside the cage, against the upper ring, when the cap is in an intermediate holding position, each first tab being supported by a first bridge; and a plurality of second flexible tabs configured to bear under the collar of the neck of the container when the cap is in the locked position, each second tab being supported by a second bridge.

3. The locking cap of claim 2, wherein the first bridges occupy between 20% and 40% of the periphery of the cage and the second bridges occupy between 40% and 70% of the periphery of the cage.

4. The locking cap of claim 3, wherein the first bridges are located, in an axial direction, between the upper ring and the second bridges, each first bridge being configured to provide an open space between the first bridge and the collar when the cap is in the intermediate holding position.

5. The locking cap of claim 4, wherein each open space has:

a height, in the axial direction, of between 0.2 mm and 2 mm; and a width, along the periphery of the cage, which is substantially equal to the width of a first bridge.

6. The locking cap of claim 1, wherein the first bridges occupy between 20% and 40% of the periphery of the cage and the second bridges occupy between 40% and 70% of the periphery of the cage.

7. The locking cap of claim 1, wherein the first bridges are located, in an axial direction, between the upper ring and the second bridges, each first bridge being configured to provide an open space between the first bridge and the collar when the cap is in the intermediate holding position.

8. The locking cap of claim 7, wherein each open space has:

a height, in the axial direction, of between 0.2 mm and 2 mm; and a width, along the periphery of the cage, which is substantially equal to the width of a first bridge.

9. A container comprising a neck having a circular opening that ends in a flared collar, and comprising a stopper arranged in the neck and connected to a locking cap according to claim 2, wherein each second tab is inclined toward the inside of the cage, in the direction of the upper ring, and the n/2 second tabs of the cage are configured to allow the cap to pass from the intermediate holding position into the locked position when a force of between 30 N and 70 N is applied to the cap.

10. The container of claim 9, wherein the n/2 second tabs of the cage are configured to allow the cap to pass from the intermediate holding position into the locked position when a force of between 30 N and 50 N is applied to the cap.

* * * * *